US005829251A

United States Patent [19]

Muraro

[11] Patent Number: 5,829,251

[45] Date of Patent: Nov. 3, 1998

[54] HYDRAULIC CONTROL CIRCUIT FOR WORKING COMPONENTS, IN PARTICULAR IN EARTH-MOVING MACHINES

[75] Inventor: Umberto Muraro, Noventa Vicentina, Italy

[73] Assignee: Fki Fai Komatsu Industries S.p.A., Noventa Vicentina, Italy

[21] Appl. No.: 806,235

[22] Filed: Feb. 24, 1997

[30] Foreign Application Priority Data

Jul. 4, 1996 [IT] Italy ..... VR96 A 000063

[51] Int. Cl.[6] ..... F15B 13/06

[52] U.S. Cl. ..... 60/421; 60/428; 60/430

[58] Field of Search ..... 60/421, 428, 430; 91/517

[56] References Cited

U.S. PATENT DOCUMENTS

| | | | |
|---|---|---|---|
| 4,454 | 6/1846 | Muller et al. | 60/521 |
| 3,916,624 | 11/1975 | Machens et al. | 60/428 |
| 3,922,855 | 12/1975 | Bridwell et al. | 60/428 |
| 4,170,124 | 10/1979 | MacGregor | 60/421 |
| 4,531,366 | 7/1985 | Moriya et al. | 60/421 |
| 4,986,072 | 1/1991 | Kubomoto | 60/421 |
| 5,052,179 | 10/1991 | Fujii | 60/421 |
| 5,083,428 | 1/1992 | Kubomoto et al. | 60/421 |

*Primary Examiner*—Sheldon Richter
*Attorney, Agent, or Firm*—Browdy and Neimark

[57] ABSTRACT

Hydraulic control circuit for working components, in particular in earth-moving machines, said machines comprising a front group provided with actuators controlled by first hydraulic distributors (1,2) and a rear excavator group provided with actuators controlled by second hydraulic distributors (3–8), in said rear excavator group there being present a main arm actuated by a main actuator (13) controlled by a main distributor (3) located upstream of the remaining second distributors (4–8). The main actuator (13) supplies in series the remaining second distributors (4–8) when the pressure downstream thereof is less than a predetermined value and instead discharges the fluid under pressure when said pressure downstream thereof reaches or exceeds said predetermined value. In the front group there is also provided an additional distributor (A–B) which sends the fluid under pressure immediately downstream of the main distributor (3) of the rear excavator group via a bypass line (23).

10 Claims, 2 Drawing Sheets

HYDRAULIC CONTROL CIRCUIT FOR WORKING COMPONENTS, IN PARTICULAR IN EARTH-MOVING MACHINES

BACKGROUND OF THE INVENTION

The present invention relates to a hydraulic control circuit for working components, in particular in earth-moving machines.

More specifically, the machines in question are of the type having a front loading-shovel group provided with actuators controlled by first hydraulic distributors, and a second rear excavator group provided with actuators controlled by second hydraulic distributors. The hydraulic distributors are all supplied with fluid under pressure coming from a first pump (or primary pump) and from a second pump (or secondary pump), the latter also supplying the hydraulic circuit for servo-assistance of the vehicle steering.

It is known that the actuators used in earth-moving machines may be supplied with hydraulic fluid under pressure using a parallel and/or series system. The two systems have advantages and drawbacks.

The parallel system allows only individual maneuvers to be performed with the actuators. In fact, this system allows simultaneous movements of the various machine components to be performed only when the pressure of the hydraulic fluid is the same in all the applications. If this is not so, the fluid would tend to go towards the application where there is the least pressure.

Therefore, in order to be able to maneuver at the same time the various components of the machine, equal pressure conditions must be created by manually throttling the applications. In practice, this depends on the skill of the operator who is operating the levers of the machine.

Compared to this drawback, the parallel system has instead the advantage that even when an actuator is at the end of its travel, all the other actuators are able to function equally well since they are not supplied by the hydraulic fluid coming from the discharge of that actuator.

As regards the series system, substantially two drawbacks may be mentioned.

The first one is that, when there is an excessively high pressure in a downstream application, this pressure value may block the movement of the actuators.

The second drawback is due to the fact that, when an actuator reaches the end of its travel, the actuators downstream thereof are blocked owing to the fact that no hydraulic fluid is supplied.

On the other hand, the series system allows simultaneous movements of the machine components to be performed. It is therefore not necessary to throttle the movements by operating the excavator levers, and thus the skill of the operator does not constitute a decisive prerequisite for simultaneous operation of the actuators required by use of the machine.

In the light of that stated above, an ideal circuit should have both the advantages of the parallel system and those of the series system, without, however, the disadvantages of the two systems.

In an attempt to achieve this result, a hydraulic circuit has been proposed (described and illustrated in Patent application No. T093A970), the main feature of which consists in the fact that it comprises: a return line of the main hydraulic distributor (i.e. that associated with the main arm of the rear excavator) towards the line supplying the hydraulic fluid under pressure coming from the main pump; and a series/parallel control valve for controlling communication between said return line and the supply line in accordance with the pressure existing in this supply line.

This type of circuit, however, is not devoid of drawbacks both of an economic and operational nature: economic, since special components of a non-commercial type are used (for example the series/parallel control valve and the main hydraulic distributor); operational since, when the actuator of the main arm of the rear excavator is at the end of its travel, it interrupts the supply to the downstream actuators. The main distributor is moreover very complex, difficult to maintain and of non-optimum reliability (owing to problems of tightness of the valves, seals, etc.).

SUMMARY OF THE INVENTION

The essential object of the present invention is therefore that of overcoming the aforementioned drawbacks in connection with the art known hitherto, by providing a hydraulic control circuit for working components, in particular in earth-moving machines, which functions using a mixed system: in certain conditions it is able to operate in series, while, in other conditions, when the series system no longer functions because the downstream pressure is too high or because the upstream actuator has reached the end of its travel, by means of an automatic system, it is possible to switch to parallel operation. These and still further objects are all achieved by the control circuit forming the subject of the present invention, the main features of which are indicated in the claims which follow.

SHORT DESCRIPTION OF THE DRAWINGS

Further characteristic features and advantages of the invention will emerge more clearly from the detailed description which follows of an example of embodiment of the circuit in question relating to an earth-moving machine, provided purely by way of a non-limiting example and illustrated in the accompanying drawings, in which.

DETAILED DESCRIPTION OF PREFERRED EMBODIMENTS

Figure 1:
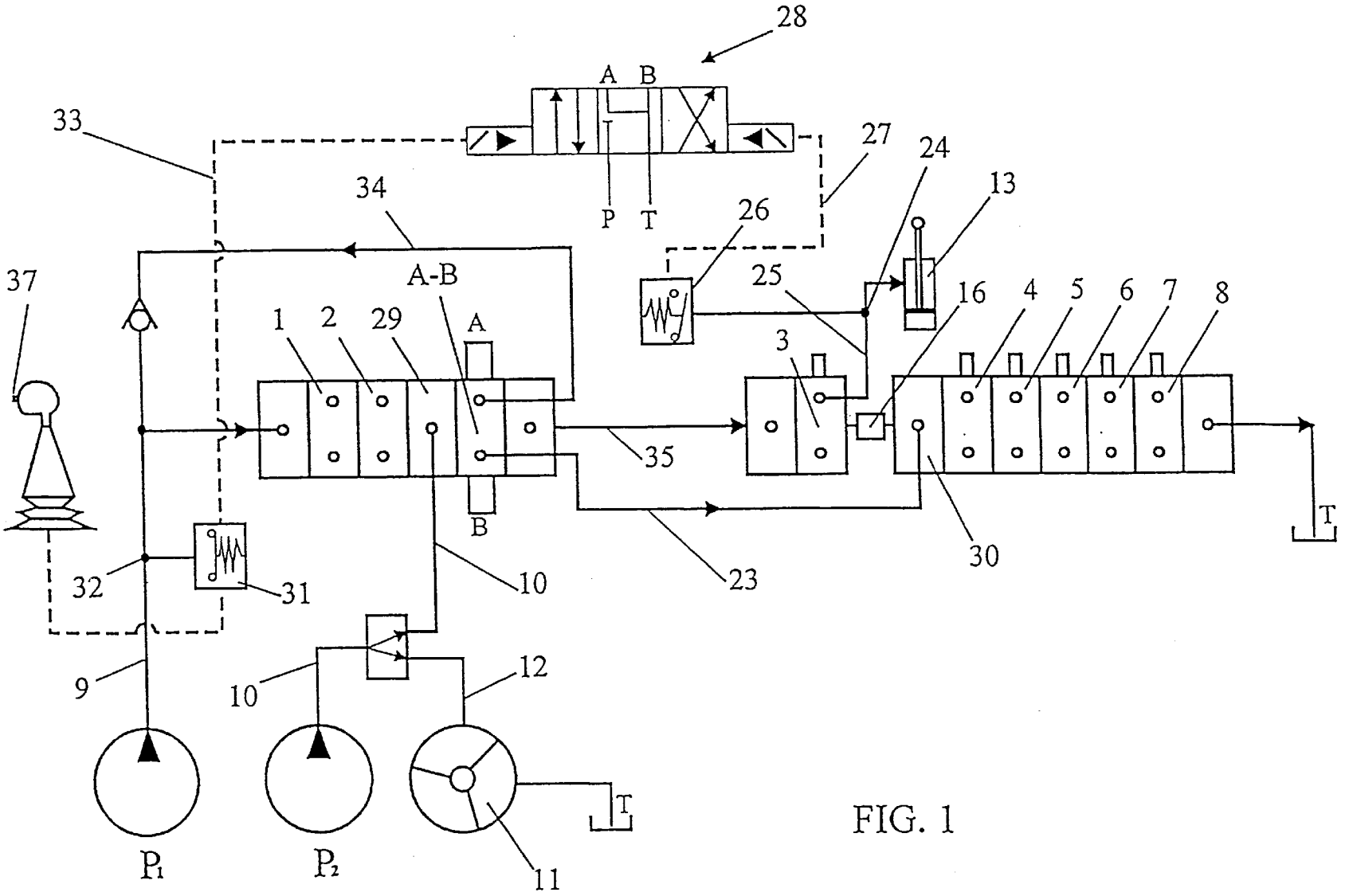
FIG. 1 shows the block diagram of a hydraulic control circuit according to the present invention.
Figure 2:
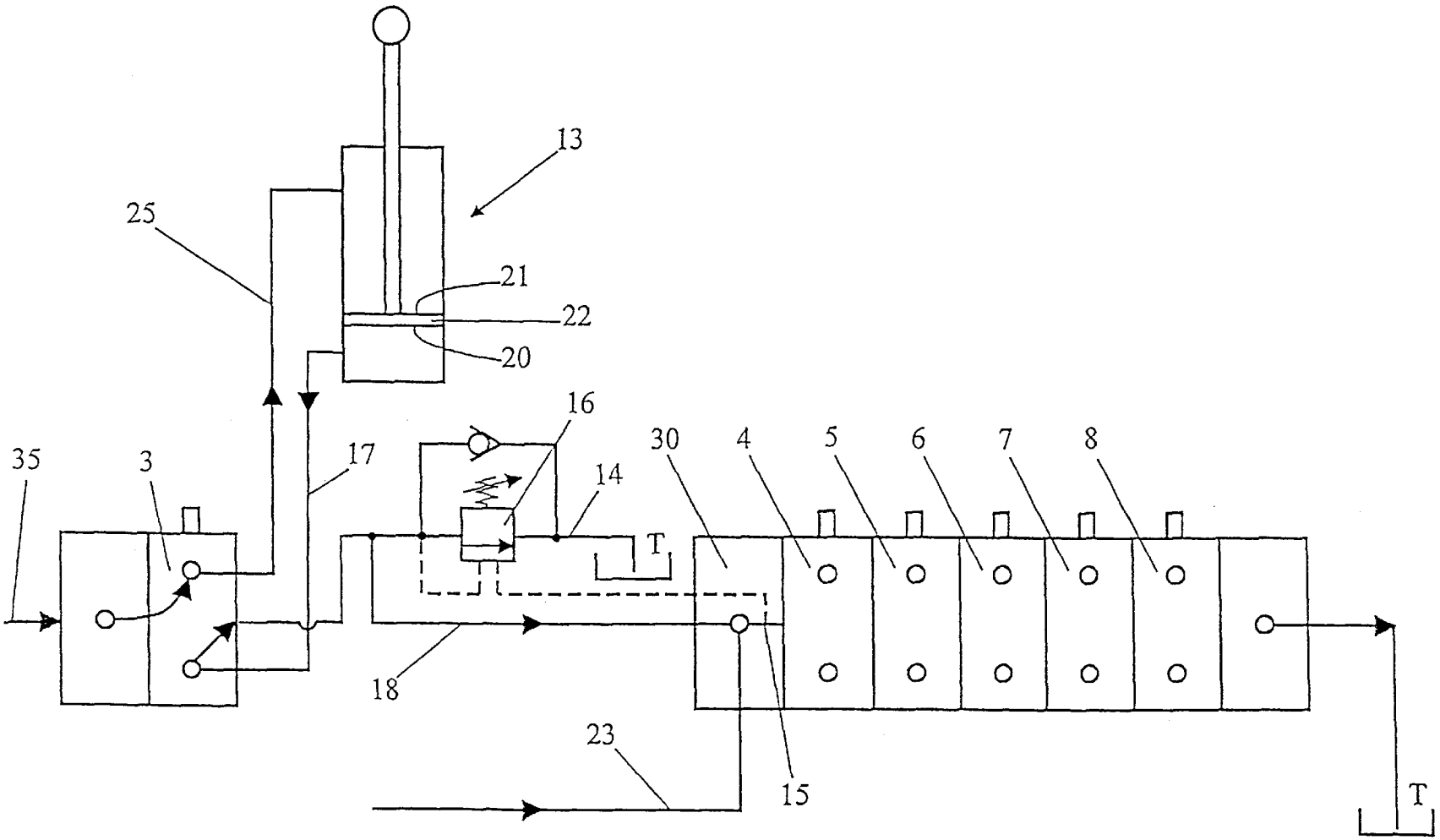
FIG. 2 shows, on a larger scale, part of the circuit according to FIG. 1 relating to the rear excavator group.

It should be noted that the circuit shown by way of example in FIGS. 1 and 2 comprises various hydraulic distributors all of the "open centre" type with a straight-moving shuttle.

The earth-moving machine for which the circuit shown in FIGS. 1 and 2 is intended comprises a front loading-shovel group (not shown) and a rear excavator group located at the rear (also not shown) comprising a main raising arm with which a second bucket-carrying arm is associated.

According to that illustrated in the accompanying figures, the working components of the front group are actuated by linear actuators controlled by first hydraulic distributors 1 and 2, while the working components of the rear excavator group are actuated by linear actuators controlled by second hydraulic distributors 3–8.

The distributors 1–8 are supplied with oil under pressure coming, via supply lines 9 and 10, from a first pump P1 (primary pump) and from a second pump P2 (secondary pump) which also supplies a steering group 11 via a supply line 12.

The aforementioned main arm of the rear excavator is actuated by a main actuator 13 controlled by the distributor 3 which will be defined as the main distributor.

The latter is located upstream of the distributors 4–8, with respect to the direction of flow of the oil under pressure.

According to that shown in FIG. 2, the main actuator 13 supplies in series, along a discharge line 17, the distributors 4–8 when the pressure downstream thereof is less than a predetermined value. Instead, it discharges, along a line 14, the oil under pressure when the pressure downstream thereof (for example at the point 15) reaches or exceeds this predetermined value, to which stoppage of the main actuator 13 corresponds.

A first valve 16 provided downstream of the discharge line 17 of the main actuator 13 allows the deviation of the flow towards the distributors 4–8, along a line 18, or towards the discharge point, along the line 14. It can be noted that, advantageously, the main actuator 13 supplies in series the distributors 4–8 with multiplication of the oil flowrate along the lines 17 and 18 by a multiplication factor K equal to the ratio between the areas of the faces 20 and 21 of the piston 22 (see FIG. 2). This factor K normally has the value 1.3 or values greater than it.

Therefore, if the main actuator 13 functions in series, there is an increase in flowrate greater than or equal to 30% (along the lines 17 and 18) which may be made available to the user points downstream.

Basically a mixed system is provided: in given conditions it is able to operate in series (improving the operational capacity of the series system because there is a multiplication of the flowrate), whereas it functions in parallel, in an automatic manner owing to the intervention of the calibrated valve 16, when it is in extreme conditions in which the series system is no longer able to function because, downstream of the valve 16, the pressure is too high or because, as will be clarified hereinbelow, the piston 22 of the main actuator 13 has reached the end of its travel.

According to that shown in FIG. 1, in the front group there is provided an additional distributor A–B which is located downstream of the distributors 1 and 2 and sends the oil under pressure immediately downstream of the main distributor 3 of the rear excavator via a bypass line 23 when the main actuator 13 has the piston 22 at the end of its travel or when the pressure, measured for example at the point 24 on the raising line 25 of the main actuator 13, is equal to or exceeds a maximum value. This maximum pressure value corresponds, as is known, to the calibration for optimum power supplied by the endothermic engine of the machine.

For this purpose, a first pressure switch 26 (or hydraulic device) is provided, said switch, by means of an electric (or hydraulic) signal sent along a line 27, operating a second solenoid valve 28 (or a servo-controlled valve) actuating the additional distributor A–B.

It should be noted that the main pump P1 supplies the distributors 1 and 2 along the line 9 emerging upstream thereof, while the secondary pump P2 supplies the additional distributor A–B along the line 10. The latter emerges in a first intermediate collector element 29 located immediately upstream of the additional distributor A–B.

A second intermediate collector element 30 is moreover located downstream of the main distributor 3 of the rear excavator. The bypass line 23 emerges in this intermediate collector element 30.

Upstream of the first distributors 1 and 2 there is provided a second pressure switch 31 picking up the pressure signal at a point 32 along the supply line 9. This pressure switch 31 electrically operates, by means of a connection 33, the second solenoid valve 28 so that when the pressure measured in the line 9 is less than a predetermined value H, the additional distributor A–B sends, owing to the action of the operator, the delivery of oil of the pump P2 into a recycling duct 34 emerging upstream of the distributors 1 and 2.

It should be noted that on an operating lever, located in the machine cabin, there is a pushbutton 37 which allows the aforementioned operator to activate the electric circuit of the pressure switch 31. In this case the loading shovel of the machine will operate more rapidly with the delivery of the two pumps P1 and P2.

When, on the other hand, the pressure measured in the supply line 9 reaches or exceeds said predefined value H, the additional distributor A–B sends all the oil under pressure (sum of the deliveries of the pumps P1 and P2) along the line 35 towards the main distributor 3 of the rear excavator.

In summary, it can therefore be concluded that:

a) The circuit structure illustrated in FIG. 2 allows switching of the series element (main distributor 3 and actuator 13) into a parallel element, when the downstream pressure (measured at 15) is greater than a reference value; the piston 22 of the actuator 13 is thus able to reach the end of its travel even if the downstream pressure is high;

b) The circuit structure illustrated in FIG. 1 allows the series element (main distributor 3) to be bypassed partially when the pressure for raising the main arm of the rear excavator (i.e. the pressure measured on the line 25) is equal to or exceeds a maximum value and/or when the main actuator 13 is at the end of its travel;

c) The circuit structure of the front loading-shovel group illustrated in FIG. 1 allows the sum of the two deliveries of the two pumps P1 and P2 to be used when the pressure value in the line 9 is less than a predetermined value H and when the operator considers it appropriate.

What is claimed:

1. Hydraulic control circuit for working components, in particular in earth-moving machines, said machines comprising a front loading-shovel group provided with actuators controlled by first hydraulic distributors (1,2) and a rear excavator group provided with actuators controlled by second hydraulic distributors (3–8), said first hydraulic distributors (1–2) and second hydraulic distributors (3–8) being supplied with hydraulic fluid under pressure coming from a first pump (P1) and a second pump (P2) by means of respective supply lines (9,10), in said rear excavator group there being present a main arm of the rear excavator actuated by a main actuator (13) controlled by a main distributor (3), said main distributor (3) being located upstream of the remaining second distributors (4–8) with respect to the direction of flow of the hydraulic supply liquid, wherein said main actuator (13) supplies in series said remaining second distributors (4–8) when the pressure downstream thereof is less than a predetermined value and instead discharges the fluid under pressure when said pressure downstream thereof reaches or exceeds said predetermined value, to which stoppage of said main actuator (13) corresponds, a first valve (16) being provided downstream of the discharge line (17) of said main actuator (13) so as to allow deviation of the flow respectively towards said remaining second distributors (4–8) or towards the discharge point; and wherein in said front group of said hydraulic control circuit there is provided an additional distributor (A–B) located downstream of said first hydraulic distributors (1,2) which sends the fluid under pressure immediately downstream of said main distributor (3) of the rear excavator group via a bypass line (23), when said main actuator (13) is at the end of its travel or when the pressure measured on the raising line (25) of said main actuator (13) is equal to or exceeds a maximum value, a first pressure switch (26), picking up the pressure signal in said raising line (25), being provided in order to operate a second (electrically or hydraulically operated) valve (28) actuating said additional distributor (A–B).

2. Hydraulic control circuit as claimed in claim 1, wherein said main actuator (13) of the rear excavator group supplies in series the remaining said second distributors (4–8) with multiplication of the flowrate of hydraulic fluid under pressure by a multiplication factor (K).

3. Hydraulic control circuit as claimed in claim 1 wherein the supply line (10) associated with said second pump (P2) emerges in said first intermediate collector element (29).

4. Hydraulic control circuit as claimed in claim 1, wherein upstream of said first distributors (1–2) there is provided a second pressure switch (31) picking up the pressure signal in one of said supply lines associated with said first pump (P1) or second pump (P2) electrically operating said second valve (28) so that when the pressure measured in said supply line is less than a predetermined value (H), said additional distributor (A–B) sends part of the fluid under pressure into a recycling duct (34) emerging upstream of said first distributors (1–2), whereas when the pressure measured in said supply line reaches or exceeds said predefined value (H), said additional distributor (A–B) sends all the fluid under pressure towards said main distributor (3) of the rear excavator group.

5. Hydraulic control circuit as claimed in claim 4, wherein said second pressure switch (31) picks up the pressure signal in the supply line (9) associated with the pump (P1), said part of the fluid under pressure sent into said recycling duct (34) being formed by the delivery of said second pump (P2).

6. Hydraulic control circuit as claimed in claim 1, wherein a second intermediate collector element (30) is located downstream of said main distributor (3) of the rear excavator group.

7. Hydraulic control circuit as claimed in claims 1, wherein said bypass line (23) emerges in said second intermediate collector element (30).

8. Hydraulic control circuit as claimed in claim 1, wherein said first pump (P1) supplies said first hydraulic distributors (1,2) upstream thereof and said second pump (P2) supplies the circuit downstream thereof.

9. Hydraulic control circuit as claimed in claim 1, wherein a first intermediate collector element (29) is located upstream of said additional distributor (A–B).

10. Hydraulic control circuit as claimed in claims 9, wherein the supply line (10) associated with said second pump (P2) emerges in said first intermediate collector element (29).

* * * * *